US011749436B2

(12) United States Patent
Dempsey et al.

(10) Patent No.: US 11,749,436 B2
(45) Date of Patent: Sep. 5, 2023

(54) METHOD FOR GENERATING A PULSED MAGNETIC FIELD AND ASSOCIATED DEVICE

(71) Applicants: CENTRE NATIONAL DE LA RECHERCHE SCIENTIFIQUE, Paris (FR); UNIVERSIDADE FEDERAL DO PARANÀ (UFPR), Curitiba (BR)

(72) Inventors: Nora Dempsey, Grenoble (FR); André Dias, Grenoble (FR); Marlio Bonfim, Curitiba (BR)

(73) Assignees: CENTRE NATIONAL DE LA RECHERCHE SCIENTIFIQUE, Paris (FR); UNIVERSIDADE FEDERAL DO PARNA (UFPR), Curitiba (BR)

( * ) Notice: Subject to any disclaimer, the term of this patent is extended or adjusted under 35 U.S.C. 154(b) by 200 days.

(21) Appl. No.: 17/430,157

(22) PCT Filed: Feb. 13, 2020

(86) PCT No.: PCT/EP2020/053767

§ 371 (c)(1),
(2) Date: Aug. 11, 2021

(87) PCT Pub. No.: WO2020/165348

PCT Pub. Date: Aug. 20, 2020

(65) Prior Publication Data

US 2022/0148780 A1 May 12, 2022

(30) Foreign Application Priority Data

Feb. 15, 2019 (EP) ..... 19305188

(51) Int. Cl.

| | |
|---|---|
| ***H01F 7/06*** | (2006.01) |
| ***H01F 7/20*** | (2006.01) |
| ***H01F 7/18*** | (2006.01) |

(52) U.S. Cl.
CPC ..... *H01F 7/064* (2013.01); *H01F 7/20* (2013.01); *H01F 7/18* (2013.01)

(58) Field of Classification Search
CPC ..... H01F 7/064; H01F 7/20; H01F 7/204
See application file for complete search history.

(56) References Cited

U.S. PATENT DOCUMENTS

| | | | | |
|---|---|---|---|---|
| 2012/0134064 | A1* | 5/2012 | Weed | H01F 7/204 361/144 |
| 2017/0236682 | A1* | 8/2017 | Yeckel | H03K 3/43 250/396 ML |
| 2020/0108265 | A1* | 4/2020 | Kawarai | H01F 7/204 |

FOREIGN PATENT DOCUMENTS

| | | |
|---|---|---|
| GB | 1 349 226 A | 4/1974 |
| JP | 20160182252 A | 10/2016 |

(Continued)

*Primary Examiner* — Michael C Zarroli
(74) *Attorney, Agent, or Firm* — WCF IP

(57) ABSTRACT

The invention concerns a method for generating a pulsed magnetic field, the method being implemented using a device (10) comprising an electrical supply (20), a switch (25), a capacitor (15) and a coil (30) having a first extremity (80) connected to an electrical ground and a second extremity (85), the capacitor (15) comprising a first electrode connected to the electrical ground and a second electrode, the switch (25) being able to commute between a first configuration wherein the second electrode and the second extremity (85) are electrically insulated and at least one second configuration wherein the second electrode and the second extremity (85) are electrically connected, the capacitor (15), the switch (25) and the coil (30) forming a series circuit when the switch (25) is in the second configuration, the series circuit being underdamped.

10 Claims, 4 Drawing Sheets

(56) References Cited

FOREIGN PATENT DOCUMENTS

Figure 1:
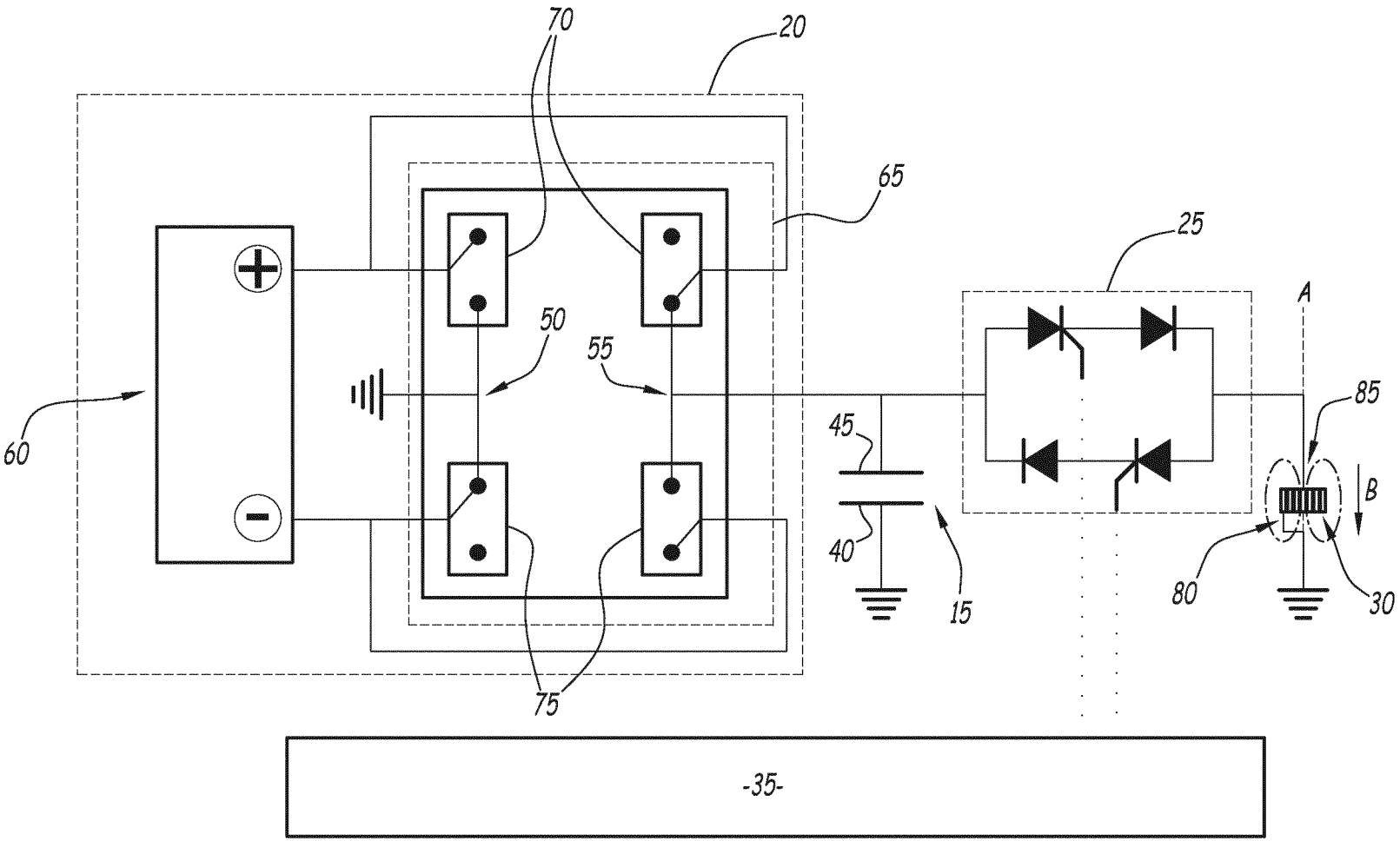

| | | | |
|---|---|---|---|
| WO | 1996/016692 | A1 | 6/1996 |
| WO | 2004/087255 | A1 | 10/2004 |

* cited by examiner

METHOD FOR GENERATING A PULSED MAGNETIC FIELD AND ASSOCIATED DEVICE

The present invention concerns a method for generating a pulsed magnetic field. The present invention also concerns a related computer program product, as well as a related information-carrying medium. The present invention further concerns a device for generating a pulsed magnetic field.

High-intensity magnetic fields, notably fields over 3 Tesla (T), are usually generated using electromagnets based on superconducting coils operated in DC mode or using electrically conductive coils operated in pulsed mode. These high-intensity magnetic fields are used in specialized measurement systems, for example for probing the properties of materials. However, most of the existing systems for generating high-intensity magnetic fields have certain drawbacks which may limit their use to certain applications.

Superconducting coils allow for very high magnetic fields up to 20 teslas (T), but require a dedicated cooling system to maintain the very low temperatures at which superconductivity is observed. The presence of these cooling systems renders systems using superconducting coils very bulky and costly, with typical dimensions being around one cubic meter or more. In addition, superconducting coils require a very high electrical current to produce high-intensity fields, which, added to the intrinsic consumption of the cooling system, results in a very high electrical consumption.

Restive coil based high-intensity magnetic field generators generally require cooling of the coil since it is heated by the Joule Effect, and the overall systems (including a current generating unit and a coil system) are typically very bulky. A certain time delay between successive magnetic field pulses is required to allow the coil to cool down.

There is therefore a need for a method for generating a high-intensity magnetic field that has a lower energy consumption than existing methods.

In this view, the present description concerns a method for generating a pulsed magnetic field, the method being implemented using a device comprising an electrical supply, a switch, a capacitor and a coil having a first extremity connected to an electrical ground and a second extremity, the capacitor comprising a first electrode connected to the electrical ground and a second electrode, the switch being able to commute between a first configuration wherein the second electrode and the second extremity are electrically insulated and at least one second configuration wherein the second electrode and the second extremity are electrically connected, the capacitor, the switch and the coil forming a series circuit when the switch is in the second configuration, the series circuit being underdamped, the method comprising:

- a first step for charging the second electrode with a first electrical charge having a first polarity, the switch having the first configuration,
- a first step for discharging the first electrical charge through the coil to generate a first pulse of magnetic field, the switch having the second configuration,
- a second step for charging the second electrode with a second electrical charge having a second polarity different from the first polarity, the switch having the first configuration, and
- a second step for discharging the second electrical charge through the coil to generate a second pulse of magnetic field, the switch having a second configuration.

The method allows for generating very intense magnetic fields B up to 20 T or more inside the coil 30, with a low power consumption since after each step for discharging 110, 140, the capacitor is partially charged with an intermediate charge corresponding to an intermediate value Vi1, Vi2 of the voltage V. Thus, the following step for charging 100, 130 only requires charging the second electrode 45 up to the required value V+, V− from the intermediate value Vi1, Vi2 and not from zero. In consequence, a lesser amount of energy is required for each step for charging 100, 130 since part of the energy accumulated in the capacitor 15 during the previous step for charging 100, 130 is available (as the intermediate value Vi1, Vi2 of the voltage V) and is thus reused.

Furthermore, the method also allows for high repetition rates in spite of the high intensity of the fields, with the pulse repetition rates being in some cases, notably depending on the type of coil used, up to 2 pulses per second or higher.

According to specific embodiments, the method comprises one or several of the following features, taken separately or according to any possible combination:

- the first step for charging, the first step for discharging, the second step for charging and the second step for discharging are repeated with a repetition rate superior or equal to once per second, notably superior or equal to twice per second.
- a capacitance is defined for the capacitor, an inductance being defined for the coil, a resistance being defined for the series circuit, the capacitance, the inductance and the resistance being such that the following equation is verified:

$$\frac{L}{R} \geq \frac{C}{0.16}$$

wherein L is the inductance, R is the resistance and C is the capacitance.

- the switch comprises two arms connected in parallel between the second extremity and the second electrode, each arm comprising a thyristor and a diode connected in series, the diode and thyristor of each arm being each inverted with respect to the diode and thyristor of the other arm.
- each first and second step for discharging is immediately followed by a temporization step, the switch being in the first configuration and the second electrode being electrically disconnected from the electrical supply during the temporization step, the temporization step having a time duration superior or equal to 5 milliseconds.
- each step for discharging comprises successively:
  - a first step for commuting the switch from the first configuration to a second configuration,
  - a step for discharging the second electrode through the coil, and
  - a second step for commuting the switch to the first configuration,
- a time period between the first step for commuting and the second step for commuting being comprised between 10 microseconds and 100 microseconds.
- each first or second step for charging comprises steps for:
  - electrically connecting the second electrode to the electrical supply,
  - estimating a value of the electrical charge of the second electrode, and disconnecting the second electrode from the electrical supply when the value of the electrical charge is equal to a predetermined value.

The present description also concerns a computer program product comprising software instructions configured to implement a method as described above when the software instructions are executed by a processor.

The present description also concerns an information-carrying medium onto which a computer program product as described above is memorized.

The present description also concerns a device for generating a pulsed magnetic field comprising an electrical supply, a switch, a capacitor, a control module and a coil having a first extremity connected to an electrical ground and a second extremity, the capacitor comprising a first electrode connected to the electrical ground and a second electrode, the switch being able to commute between a first configuration wherein the second electrode and the second extremity are electrically insulated and at least one second configuration wherein the second electrode and the second extremity are electrically connected, the capacitor, the switch and the coil forming a series circuit when the switch is in the second configuration, the series circuit being underdamped, the electrical supply being able to commute being a third configuration wherein the electrical supply is able to charge the second electrode with an electrical charge having a first polarity and a fourth configuration wherein the electrical supply is able to charge the second electrode with an electrical charge having a second polarity different from the first polarity, the control module being able to command the electrical supply to commute between the third configuration and the fourth configuration, the control module further being able to command the supply to connect to or disconnect from the second electrode, the control module being configured to implement the steps of a method.

Figure 2:
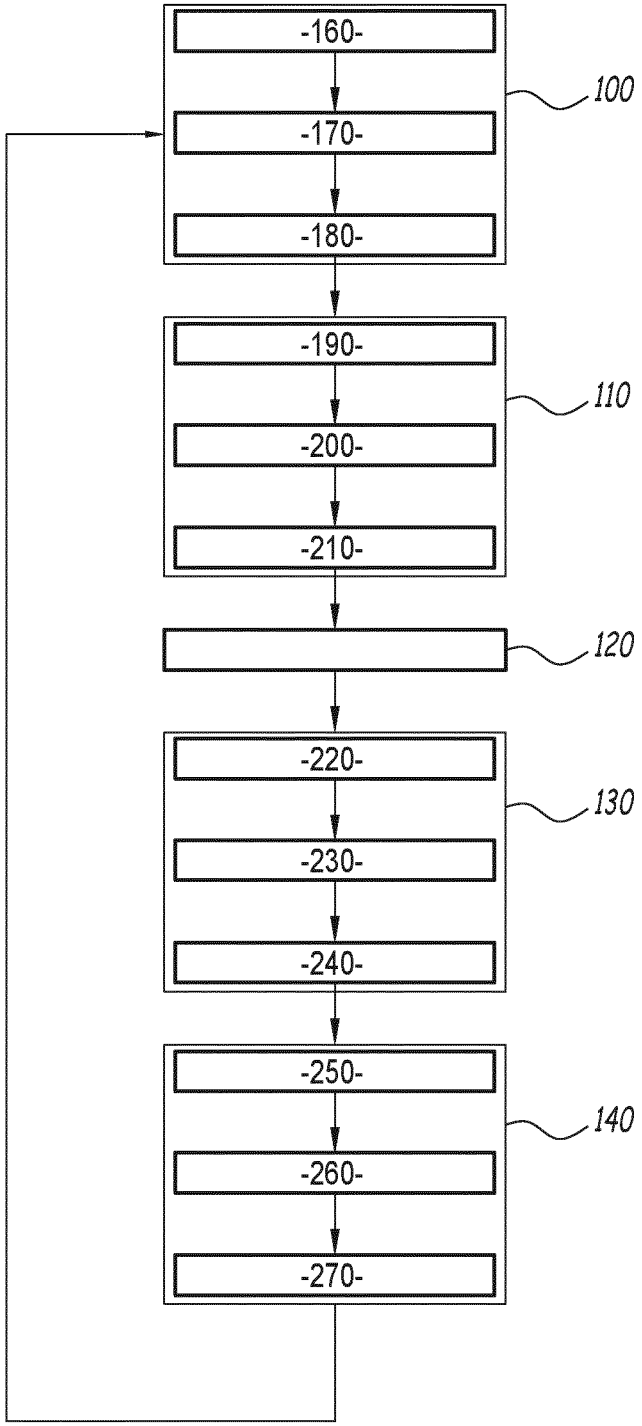
Figure 3:
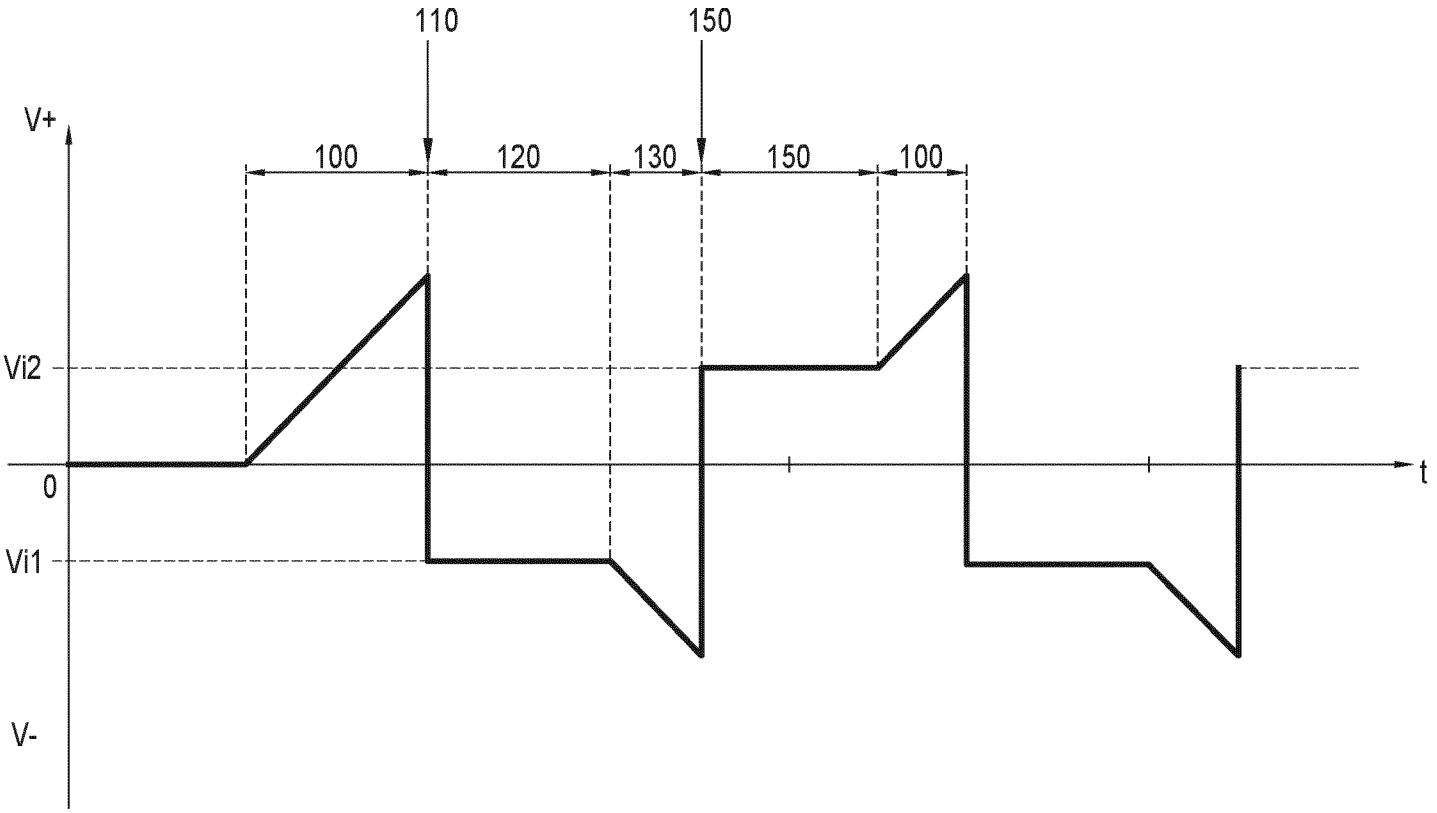
Figure 4:
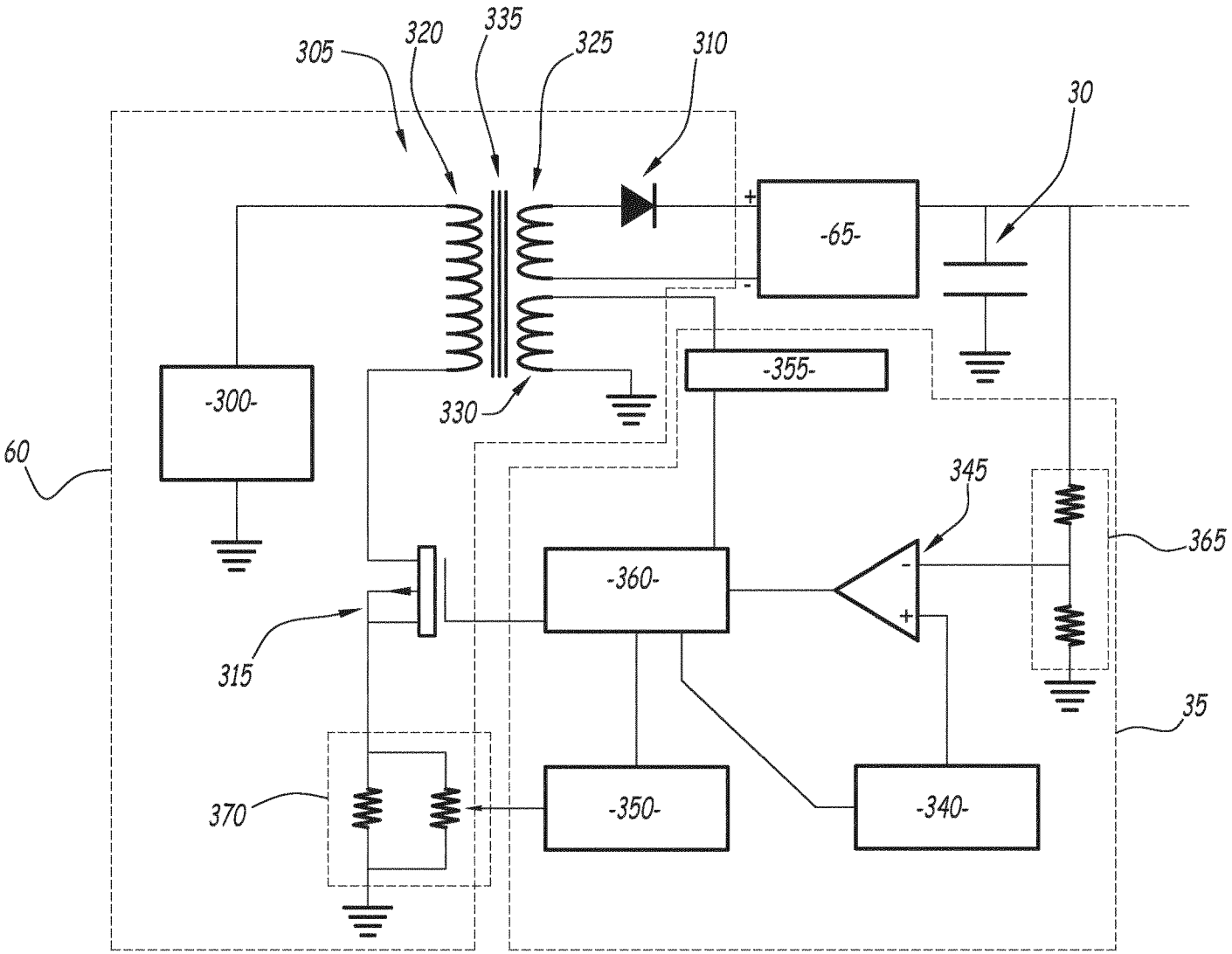

Features and advantages of the invention will be made clear by the following specification, given only as a non-limiting example, and making a reference to the annexed drawings, on which:

FIG. 1 is a diagram of a device for generating a pulsed magnetic field, comprising a capacitor and an electrical supply, FIG. 2 is a flowchart showing the steps of a method for generating a pulsed magnetic field implemented by the device of FIG. 1, FIG. 3 is a graph showing the evolution of the voltage between both electrodes of the capacitor of FIG. 1, and FIG. 4 is a partial diagram of the device of FIG. 1, showing in greater details the electrical supply.

A diagram of a generating device 10 is shown on FIG. 1. The generating device 10 is configured to generate a pulsed magnetic field B. A pulsed magnetic field is a magnetic field comprising a succession of pulses, each pulse corresponding to a time period wherein the magnetic field has a value different from zero. The pulses are repeated at a certain rate, the pulses being notably separated from each other by a time interval wherein the magnetic field has a value equal to zero.

Each pulse has, for example, a quasi-half-cycle of sinusoidal shape, where the magnetic field varies from zero to its peak value than returns to zero A bipolar pulsed magnetic field is an example of a pulsed magnetic field comprising successive pulses of opposite polarity. A unipolar pulsed magnetic field, wherein successive pulses have the same polarity, is another example of a pulsed magnetic field.

The generating device 10 is, for example, part of a measurement installation designed to perform measurement on one or several samples of materials when the samples are exposed to a pulsed magnetic field B produced by the generating device 10. However, other types of installations having different purposes than measurement may also make use of the generating device 10.

The measurement installation comprises, for example, a magneto-optical setup, where a laser beam is sent onto the sample when the sample or samples are exposed to the pulsed magnetic field B.

The generating device 10 comprises a capacitor 15, an electrical supply 20, a switch 25, a coil 30 and a control module 35.

The capacitor 15 has a capacitance C. The capacitance C is, for example, comprised between 5 microfarad (μF) and 200 μF.

The capacitor 15 comprises a first electrode 40 and a second electrode 45.

Both electrodes 40 and 45 are separated from each other by a film of a dielectric material. The dielectric material is, for example, polyester.

Both electrodes 40, 45 are made of an electrically conductive material such as a metallic material. For example, both electrodes 40, 45 are made of aluminum.

The first electrode 40 is grounded, i.e. electrically connected to an electrical ground of the generating device 10.

The second electrode 45 is connected to the switch 25.

The electrical supply 20 is configured to charge the second electrode 45 with an electrical charge.

In particular, the electrical supply 20 is able to charge the second electrode 45 with an electrical charge having a first polarity. For example, the first polarity is a positive polarity, corresponding to a second electrode 45 charged with electrically positive charges. In an embodiment, the electrical supply 20 is configured to charge the second electrode 45 with an electrical charge having the first polarity by imposing a positive electrical potential to the second electrode 45.

The electrical supply 20 is further able to charge the second electrode 45 with an electrical charge having a second polarity. For example, the second polarity is a negative polarity, corresponding to a second electrode 45 charged with electrically negative charges. In an embodiment, the electrical supply 20 is configured to charge the second electrode 45 with an electrical charge having the second polarity by imposing a negative electrical potential to the second electrode 45.

Each electrical potential is defined with respect to the electrical potential of the electrical ground of the generating device 10.

The electrical supply 20 comprises a first pole 50 and a second pole 55.

The first pole 50 is grounded.

The second pole 55 is electrically connected to the second electrode 45.

The electrical supply 20 is configured to impose an electrical current between the first pole 50 and the second pole 55.

The electrical supply 20 is further able to leave the electrical potential of the second pole 55 floating.

In the embodiment shown on FIG. 1, the electrical supply 20 comprises a current source 60 and a commuting device 65.

The current source 60 comprises a positive output + and a negative output −.

The current source 60 is able to impose an electrical current between the positive output + and the negative output −.

Among the positive output + and the negative output −, the positive output + has the higher electrical potential whereas the negative output − has the lower electrical potential.

The commuting device 65 is able to connect the positive output + to the second pole 55. The commuting device 65 is further able to connect the positive output + to the first pole 50. In addition, the commuting device 65 is able to disconnect the positive output + from both poles 50 and 55.

The commuting device 65 is able to connect the negative output − to the second pole 55. The commuting device 65 is further able to connect the negative output − to the first pole 50. In addition, the commuting device 65 is able to disconnect the negative output − from both poles 50 and 55.

In the embodiment shown on FIG. 1, the commuting device is a H-bridge comprising two first commuters 70 and two second commuters 75.

Each first commuter 70 is electrically connected to the positive output +. One of the first commuters 70 is able to commute between a position wherein the positive output + is connected to the first pole 50 and a position wherein the positive output + is disconnected from the first pole 50. The other first commuter 70 is able to commute between a position wherein the positive output + is connected to the second pole 55 and a position wherein the positive output + is disconnected from the second pole 55.

Each second commuter 75 is electrically connected to the negative output −. One of the second commuters 75 is able to commute between a position wherein the negative output − is connected to the first pole 50 and a position wherein the negative output − is disconnected from the first pole 50. The other second commuter 75 is able to commute between a position wherein the negative output − is connected to the second pole 55 and a position wherein the negative output − is disconnected from the second pole 55.

The first and second commuters 70, 75 are, for example, electromechanical or solid state relays.

The switch 25 is interposed between the second electrode 45 and the coil 30.

The switch 25 is able to commute between a first configuration and at least one second configuration.

When the switch 25 is in the first configuration, the second electrode 45 is electrically insulated from the coil 30. The first configuration is sometimes called the "off-state".

When the switch 25 is in a second configuration, the second electrode 45 is electrically connected to the coil 30.

In the example shown on FIG. 1, the switch 25 comprises two parallel arms comprising each a diode and a thyristor connected in series between the coil 30 and the second electrode, the diode and thyristor of each arm being each inverted with respect to the diode and thyristor of the other arm. It should be noted that other types of switches 25 may be envisioned.

Each thyristor may, for example, be of the Silicon Controlled Rectifier (SCR) type, although other types of thyristors may be considered.

In the example of FIG. 1, the switch 25 has two second configurations. In one of the second configurations, one first arm allows an electrical current to flow from the second electrode 45 to the coil 30, whereas the other arm, called the second arm, does not allow any electrical current to flow through this other arm. In the other second configuration, the second arm allows an electrical current to flow in the opposite direction from the coil 30 to the second electrode 45, while the first arm does not allow any electrical current to flow through the first arm.

It should be noted that other types of switches 25 may be considered, for example having a single second configuration allowing for electrical current to flow in any direction between the coil 30 and the second electrode 45.

The coil 30 is configured to generate the electric field B when the coil 30 is traversed by an electrical current.

The coil 30 has an inductance L. The inductance L is comprised between 100 nanohenrys (nH) and 10 microhenrys (μH).

The coil 30 has a first extremity 80 and a second extremity 85.

The first extremity 80 is grounded.

The second extremity 85 is connected to the switch 25.

The coil 30 comprises, for example, a ribbon coiled around an axis A. In particular, the ribbon is a spiral ribbon, i.e the ribbon is coiled along a spiral line comprised in a plane perpendicular to the axis A. It should be noted that other types of coils than ribbons, such as coils 30 comprising a coiled wire, may be considered.

The ribbon has, for example, a rectangular cross-section, the longest side of the cross-section being parallel to the axis A. In other words, the axis A is parallel to the surface of the ribbon.

The ribbon is made of an electrically conductive material such as a metal, notably copper.

The first extremity 80 is, for example, the extremity of the ribbon that is located at the outside of the coil 30, while the second extremity 85 is the extremity of the ribbon that is located at the center of the coil 30. In a variant, the first extremity 80 is the inner extremity of the ribbon and the second extremity 85 is the outer extremity of the ribbon.

The coil 30 further comprises an electrically insulating material forming a barrier between successive turns of the coil. The ribbon is, for example, encased in a sheath of the electrically insulating material. In a variant of the coil 30, one side of the ribbon is covered in the electrically insulating material, for example by a ribbon of the electrically insulating material.

The electrically insulating material is, for example, polyimide.

The capacitor 15, the switch 25 and the coil 30 form a series electrical circuit when the switch 25 is in the second configuration.

An electrical resistance R is defined for the electrical circuit. The electrical resistance R is the resistance of a series RLC circuit equivalent to the electrical circuit formed by the capacitor 15, the switch 25 and the coil 30.

The electrical resistance R is comprised between 10 milliohms (mΩ) and 200 mΩ.

The electrical circuit is underdamped. An underdamped electrical circuit is an electrical circuit whose equivalent RLC circuit has a damping ratio ζ comprised, strictly, between 0 and 1.

The damping ratio ζ is equal to one half of the product of the resistance R multiplied by the square root of the ratio of the capacitance C divided by the inductance L.

In other words, the electrical circuit verifies the following equation:

$$0 < \varsigma = \frac{R}{2}\sqrt{\frac{C}{L}} < 1 \qquad \text{(Equation 1)}$$

In an embodiment, the damping ratio ζ is strictly superior to zero and inferior or equal to 0.2. In other words, the electrical circuit is such that the following equation is respected:

$$0 < \frac{R}{2}\sqrt{\frac{C}{L}} \leq 0.2 \quad \text{(Equation 2)}$$

Equation 2 is formally equivalent to equation 3 below:

$$\frac{L}{R} \geq \frac{C}{0.16} \quad \text{(Equation 3)}$$

The control module 35 is able to command the commuting device 65. In particular, the control module 35 is able to command a commutation of each commuter 70, 75 between its two respective configurations.

The control module 35 is further able to command the switch 25 to commute between its first configuration and its second configuration.

The control module 35 is in particular configured to implement a method for generating a pulsed magnetic field. For example, the control module 35 comprises a processor and a memory comprising software instructions that causes the implementation of the method when the software instructions are executed by the processor.

It should be noted other types of control modules 35 may be envisioned. For example, the control module 35 is an application-specific integrated circuit, or comprises a set of programmable logic components.

The steps of an example of the method for generating a pulsed magnetic field are shown on FIG. 2.

The method comprises a first step for charging 100, a first step for discharging 110, a first temporization step 120, a second step for charging 130, a second step for discharging 140 and a second temporization step 150.

During the first step for charging 100, the electrical supply 20 charges the second electrode 45 with a first electrical charge. The switch 25 has the first configuration when the second electrode 45 is being charged with the first electrical charge.

The first electrical charge is, for example, a positive electrical charge. In other words, the first electrical charge has the first polarity.

FIG. 3 shows the evolution of a voltage V measured between the first electrode 40 and the second electrode 45 as a function of time t during implementation of the method for generating a pulsed magnetic field B.

During the first step for charging 100, the voltage V increases until reaching a first value V+ during the first step for charging 100. For example, during the first step for charging 100 shown on the left of FIG. 3, the voltage V increases from zero to the first value V+.

The first value V+ is comprised, in absolute value, between 10 Volts and 1000 Volts. It should be noted that the first value V+ may vary.

According to an embodiment, the first step for charging 100 comprises a first step for connecting 160, a first step for estimating 170 and a first step for disconnecting 180.

In particular, during the first step for connecting 160, the second electrode 45 is electrically connected to the positive output + of the electrical supply 20. The electrical supply 20 thus begins charging the second electrode 45 with the first electrical charge.

During the first step for connecting 160, the control module 35 commands the commuting device 65 to commute the commuters 70 and 75 so as to electrically connect the positive output + to the second electrode and to connect the negative output – to the ground. This configuration is shown on FIG. 1.

The first step for estimating 170 is implemented immediately after the first step for connecting 160. In particular, during the first step for estimating 170, the second electrode 45 is electrically connected to the positive output +.

The first step for estimating 170 comprises the estimation of a value of the first electrical charge of the second electrode 45. For example, during the first step for estimating, the value of the voltage V, which depends on the value of the first charge, is measured by the control module 35.

The first step for estimating 170 is performed until the value of the first charge is equal to a predetermined value. For example, the first step for estimating 170 is performed until the value of voltage V is equal to the first value V+.

The first value V+ is, for example, chosen after calculation or testing of the generating device 10 has led to ascertaining that the first value V+ corresponds to a wanted value of the magnetic field B.

When the value of the first charge is equal to the predetermined value, the second electrode 45 is disconnected from the electrical supply 20 during the first step for disconnecting 180. For example, the first step for disconnecting 180 is performed when the value of the voltage V is equal to the first value V+.

During the first step for discharging 110, the first electrical charge is discharged through the coil 30. For example, the control module 35 commands the electrical supply 20 to disconnect both the positive output + and the negative output – from the second electrode 45, and commands the switch 25 to commute to the second configuration.

The first step for discharging 110 comprises, successively, a first step 190 for commuting, a first discharge step 200 and a second step 210 for commuting.

During the first step for commuting 190, the control module 35 commands the electrical supply 20 to disconnect the positive output + from the second electrode 45. The control module 35 further commands the switch 25 to commute from the first configuration to a second configuration.

During the first discharge step 200, the second electrode 45 discharges the first electrical charge through the coil 30. In particular, a first electrical current flows through the second electrode 45, the switch 25 and the coil 30.

The first electrical current flowing through the coil causes a first pulse of magnetic field B to be generated by the coil 30.

The first discharge step 200 has a time duration comprised between 10 microseconds (μs) and 100 μs.

During the first discharge step 200, the voltage V of the capacitor 15 decreases from the first value V+. Since the electrical circuit formed by the coil 30, the capacitor 15 and the switch 25 is underdamped, the first discharge step 200 results in the voltage V decreasing from the first value V+ to first intermediate value Vi1. In particular, at the end of the first discharge step 200, the voltage V of the capacitor 15 has the first intermediate value Vi1.

The first intermediate value Vi1 corresponds to a first intermediate charge of the second electrode 45.

The first intermediate value Vi1 has a sign opposed to the first value V+, i.e. the first intermediate value is a negative value.

The first intermediate value Vi1 has an absolute value strictly superior to zero and strictly inferior to the absolute value of the first value V+. For example, the absolute value of the first intermediate value Vi1 is superior or equal to half of the absolute value of the first value V+.

After the first discharge step 200, the switch 25 is commuted back to the first configuration during the second step 210 for commuting.

A time period between the first step for commuting 190 and the second step for commuting 210 is equal to the time duration of the first discharge step 200.

During the first temporization step 120, the switch 25 is kept in the first configuration and the second electrode 45 is electrically disconnected from each of the positive and negative outputs + and −. The first temporization step 120 has a time duration superior or equal to 5 milliseconds (ms).

During the second step for charging 130, the electrical supply 20 charges the second electrode 45 with a second electrical charge. The switch 25 has the first configuration when the second electrode 45 is being charged with the second electrical charge.

The second electrical charge has the second polarity. The second electrical charge is, for example, a negative electrical charge.

During the second step for charging 130, the voltage V decreases until reaching a second value V− during the second step for charging 130. For example, during the second step for charging 130 shown on the left of FIG. 3, the voltage V decreases from the first intermediate value Vi1 to the second value V−.

The second value V− is comprised in absolute value, between 10 Volts and 1000 Volts.

The second value V− has, for example, an absolute value equal to the absolute value of the first value V+, as shown on FIG. 3. However, the absolute value of the second value V− may also, in some cases, be different from the absolute value of the first value V+.

According to an embodiment, the second step for charging 130 comprises a second step for connecting 220, a second step for estimating 230 and a second step for disconnecting 240.

In particular, during the second step for connecting 220, the second electrode 45 is electrically connected to the negative output − of the electrical supply 20. The electrical supply 20 thus begins charging the second electrode 45 with the second electrical charge.

During the second step for connecting 220, the control module 35 commands the commuting device 65 to commute the commuters 70 and 75 so as to electrically connect the negative output − to the second electrode 45 and to connect the positive output + to the ground.

The second step for estimating 230 is implemented immediately after the second step for connecting 220. In particular, during the second step for estimating 230, the second electrode 45 is electrically connected to the negative output −.

The second step for estimating 230 comprises the estimation of a value of the second electrical charge of the second electrode 45. For example, during the first step for estimating, the value of the voltage V, which depends on the value of the second charge, is measured by the control module 35.

The second step for estimating 230 is performed until the value of the second charge is equal to a predetermined value. For example, the second step for estimating 230 is performed until the value of voltage V is equal to the second value V−.

The second value V− is, for example, chosen after calculation or testing of the generating device 10 has led to ascertaining that the second value V− corresponds to a wanted value of the magnetic field B.

When the value of the second charge is equal to the predetermined value, the second electrode 45 is disconnected from the electrical supply 20 during the second step for disconnecting 240. For example, the second step for disconnecting 240 is performed when the value of the voltage V is equal to the second value V−.

During the second step for discharging 140, the second electrical charge is discharged through the coil 30. For example, the control module 35 commands the electrical supply 20 to disconnect both the positive output + and the negative output − from the second electrode 45, and commands the switch 25 to commute to the second configuration.

The second step for discharging 140 comprises, successively, a third step 250 for commuting, a second discharge step 260 and a fourth step 270 for commuting.

During the third step for commuting 250, the control module 35 commands the electrical supply 20 to disconnect the negative output − from the second electrode 45.

The control module 35 further commands the switch 25 to commute from the first configuration to the second configuration.

During the second discharge step 260, the second electrode 45 discharges the second electrical charge through the coil 30. In particular, a second electrical current flows through the second electrode 45, the switch 25 and the coil 30.

The second electrical current flowing through the coil causes a second pulse of magnetic field B to be generated by the coil 30.

Since the second electrical current flows in an inverse direction to the first electrical current, the second magnetic pulse is opposed in polarity to the first magnetic pulse. The overall pulsed magnetic field is thus a bipolar magnetic field since successive pulses are of opposite polarities.

It should be noted that in some embodiments, if the connections between the coil 30 and the switch 25 are modified between both discharge steps 200, 260, unipolar pulsed magnetic fields may be generated. For example, during the first discharge step 200, the switch 25 is electrically connected to the second extremity 85 while the first extremity 80 is grounded, the switch 25 being connected to the first extremity 80 while the second extremity 85 is grounded during the second discharge step 260. Such changes of connections may be obtained through many kinds of connecting structures.

The second discharge step 260 has a time duration comprised between 10 μs and 100 its.

During the second discharge step 260, the voltage V of the capacitor 15 increases from the second value V−. Since the electrical circuit formed by the coil 30, the capacitor 15 and the switch 25 is underdamped, the second discharge step 260 results in the voltage V increasing from the second value V− to a second intermediate value Vi2. In particular, at the end of the second discharge step 260, the voltage V of the capacitor 15 has the second intermediate value Vi2.

The second intermediate value Vi2 corresponds to a second intermediate charge of the second electrode 45.

The second intermediate value Vi2 has a sign opposed to the second value V−, i.e. the second intermediate value Vi2 is a positive value.

The second intermediate value Vi2 has an absolute value strictly superior to zero and strictly inferior to the absolute value of the second value V−. For example, the absolute value of the second intermediate value Vi2 is superior or equal to half of the absolute value of the second value V−.

After the second discharge step 260, the switch 25 is commuted back to the first configuration during the fourth step 270 for commuting.

A time period between the third step for commuting 250 and the fourth step for commuting 270 is equal to the time duration of the second discharge step 260.

During the second temporization step 150, the switch 25 is kept in the first configuration and the second electrode 45 is electrically disconnected from each of the positive and negative outputs + and −. The second temporization step 150 has a time duration superior or equal to 5 ms.

After the second temporization step 150, the first step for charging 100 is implemented again, with the voltage V increasing to the first value V+ from the second intermediate value Vi2 instead of from zero.

The first step for charging 100, the first step for discharging 110, the first temporization step 120, the second step for charging 130, the second step for discharging 140 and the second temporization step 150 are repeated in this order at a rate superior or equal to once every second, for example superior or equal to twice per second.

In the example given above and detailed by FIGS. 2 and 3, the method begins with a first step for charging 100 being implemented, starting with the voltage V being equal to zero and the voltage V increasing until reaching the first value V+. However, examples wherein the method starts with the implementation of a second step for charging 130 starting with the voltage V being equal to zero and the voltage V decreasing until reaching the second value V− may also be envisioned.

The method allows for generating very intense magnetic fields B up to 20 T or more inside the coil 30, with a low power consumption since after each step for discharging 110, 140, the capacitor is partially charged with an intermediate charge corresponding to an intermediate value Vi1, Vi2 of the voltage V. Thus, the following step for charging 100, 130 only requires charging the second electrode 45 up to the required value V+, V− from the intermediate value Vi1, Vi2 and not from zero. In consequence, a lesser amount of energy is required for each step for charging 100, 130 since part of the energy accumulated in the capacitor 15 during the previous step for charging 100, 130 is available (as the intermediate value Vi1, Vi2 of the voltage V) and is thus reused.

In particular, the method allows for generating pulsed high-intensity magnetic fields with a repetition rate of up to 2 pulses per second or higher.

In addition, the generating device 10 has smaller dimensions than existing generating devices.

Furthermore, the method allows for pulses of different amplitudes to be generated simply by adapting the first and second values V+ and V− of the voltage V. The method is thus easily adaptable. In particular, the method allows for generating first and second pulses having different amplitudes.

However, when the first and second values V+ and V− of the voltage V are equal to each other, the method allows successive pulses to exhibit very high levels of symmetries, i.e. successive positive and negative pulses are, in absolute value of the magnetic field, very similar to each other. This symmetry is notably improved when compared to other types of devices for generating magnetic fields.

When the damping ratio $\zeta$ is strictly superior to zero and inferior or equal to 0.2, the intermediate values Vi1, Vi2 are each superior or equal (in absolute value) to half of the previous first or second value V+, V−. The overall power efficiency of the method is thus improved.

The efficiency is further improved when the duration of the discharge steps 200 and 260 is comprised between 10 μs and 100 μs.

When the switch 25 comprises parallel arms comprising each one thyristor and one diode, the return of charges from one electrode of the capacitor 15 to the other through the coil 30 if the switch 25 is not opened (i.e. returned to its first position) at the end of each first or second discharge step 200, 260. This ensures that the part of the energy that is accumulated in the capacitor 15 is not dissipated through the Joule effect but remains stored until the next first or second discharge step 200, 260 is implemented, thus resulting in a lower power consumption.

Ribbon coils are very resistant mechanically to forces caused by the high magnetic fields B, thus improving reliability of the generating device 10. In particular, ribbon coils using polyimide as their insulating material are very resistant as well as having a low chance of electrical shortcut even when polarized with high voltages due to the high breakdown voltage of polyimide The good mechanical and/or electrical toughness allow the coil 30 to withstand relatively high repetition rates for prolonged time periods. The device 10 thus allows for safely generating high repetition rate pulsed magnetic fields. It should be noted that high-repetition rate pulsed magnetic fields may be obtained using other types of coils 30, although the lifetime of the generating device 10 may vary depending on the type of coil 30.

The use of temporization steps 120, 150 having time durations of 5 ms or more allow for the commuters 70 and 75 to stabilize.

A partial diagram of the generating device 10 is shown on FIG. 4, showing in more detail an example of the voltage source 60 and the control module 35.

The current source 60 is of the "flyback" type. Flyback sources, also called "flyback converters" operate by alternately energizing a transformer and transferring the stored energy to the device that the flyback source is designed to electrically supply.

The current source 60 comprises an electrical source 300, a transformer 305, a diode 310 and a third commuter 315.

The electrical source 300 comprises one pole electrically connected to the transformer 305 and one grounded pole. The electrical source 300 is configured to impose a voltage between both of its poles. For example, the electrical source 300 is a DC source.

The transformer 305 comprises a primary winding 320, a secondary winding 325, a tertiary winding 330 and a core 335.

The primary winding 320 is connected at one extremity to the electrical source 300 and at another extremity to the third commuter 315.

The secondary winding 325 is connected at one extremity to the diode 310 and at another extremity to the negative output − of the current source 60.

The tertiary winding 330 has one grounded extremity and another extremity connected to the control module 35.

The core 335 is made of a ferromagnetic material such as ferrite.

The diode 310 is mounted between the secondary winding 325 and the positive output +, so as to allow an electrical current flowing from the secondary winding to the positive output and preventing an electrical current from flowing in the reverse direction.

The third commuter 315 is interposed between the primary winding 320 and the electrical ground. The third commuter 315 is able to either allow or prevent passage of an electrical current between the primary winding 320 and the ground.

The third commuter 320 is, for example, a transistor such as a metal-oxide-semiconductor field-effect transistor (MOSFET). However, other types of third commuters 320 may be envisioned.

The control module 35 comprises a data treatment unit 340, a comparator 345, a current sensor 350, an energy sensor 355 and a command module 360.

The data treatment unit 340 comprises, for example, the memory, the processor and a human interface.

The data treatment unit 340 is notably able to control the comparator 345 and the command module 350.

The comparator 345 is able to estimate a value of the voltage V of the capacitor 30. For example, the comparator 345 is able to generate a first signal when the voltage V is different from a predetermined value and a second signal when the voltage V is equal to the predetermined value. The predetermined value is, for example, set by the data treatment unit 340 to be equal to either the first value V+ or second value V−.

In the example of FIG. 4, the comparator 345 is connected to a middle point of a voltage divider 365 connected in parallel between the second electrode 45 and the ground and compares the voltage between the middle point and the ground to a voltage applied by the data treatment unit 340 to an input of the comparator 345.

The current sensor 350 is configured to measure a value of a current flowing through the primary winding 320. The current sensor 350 is, for example, able to measure a voltage between the poles of a current divider 370 interposed between the third commuter 315 and the ground.

The current sensor 350 is, notably, configured to send a signal representative of the value of the current to the command module 360.

The energy sensor 355 is able to detect a level of energy stored in the transformer 305. For example, the energy sensor 305 detects a level of energy on the transformer 305, by simply measuring the voltage across the tertiary winding 330. When this voltage goes to zero, the magnetic energy inside the core 335 is completely transferred to the capacitor 15, allowing for a new charging cycle. The command module 360 is configured to command the third commuter 315 to either allow or prevent passage of an electrical current between the primary winding 320 and the ground.

The operation of the current source 60 during one of the first and second steps for estimating 200, 260 will now be described.

When the third commuter 315 is closed, an electrical current flows from the electrical source 300, the primary winding 320, the third commuter 315 and the current divided 370 until reaching the ground.

This electrical current increases over time, as energy is stored in the transformer 305.

The command module 360 commands the third commuter 315 to allow this electrical current to flow until the intensity of the electrical current, measured by the current sensor 350, reaches a predetermined level fixed by the control module 340, as long as the comparator 345 estimates that the voltage V has an absolute value strictly inferior to predetermined value fixed by the data treatment unit 340.

The electrical current flowing through the primary winding 320 causes a voltage to appear between the extremities of the secondary winding 325, and thus between the positive and negative outputs + and −.

When the intensity of the electrical current through the primary winding reaches the predetermined level, the third commuter 315 is opened by the command module 340 to interrupt the current. The transformer then discharges its energy through the secondary winding 325 by causing an electrical current to flow to the second electrode 45, thus charging the second electrode 45.

When the energy sensor 355 detects that the transformer 305 has been emptied of energy through the secondary winding 325, the command module 360 orders the closing of the third commuter 315, thereby causing the electrical current flowing through the first winding 320 to reappear.

Thus, as long as the voltage V is different from the predetermined value (i.e. the first value V+ or the second value V−), the command module 360 successively opens and closes the third commuter 315, thereby causing a voltage and/or a current to appear intermittently between the extremities of the secondary winding 325. This voltage and/or current is rectified by the diode 310 so that successive pulses of current are generated between the positive and negative outputs + and −.

The use of such a current source 60 allows for an efficient limitation of the current charging the second electrode 45, thus preventing any degradation of the generating device 10 because of overcurrents, while consuming little power compared to other types of sources.

The invention claimed is:

1. A method for generating a pulsed magnetic field, the method being implemented using a device comprising an electrical supply, a switch, a capacitor and a coil having a first extremity connected to an electrical ground and a second extremity, the capacitor comprising a first electrode connected to the electrical ground and a second electrode, the switch being able to commute between a first configuration wherein the second electrode and the second extremity are electrically insulated and at least one second configuration wherein the second electrode and the second extremity are electrically connected, the capacitor, the switch and the coil forming a series circuit when the switch is in the second configuration, the series circuit being underdamped, the method comprising:

a first step for charging the second electrode with a first electrical charge having a first polarity, the switch having the first configuration, a first step for discharging the first electrical charge through the coil to generate a first pulse of magnetic field, the switch having the second configuration, a second step for charging the second electrode with a second electrical charge having a second polarity different from the first polarity, the switch having the first configuration, and a second step for discharging the second electrical charge through the coil to generate a second pulse of magnetic field, the switch having a second configuration.

2. The method according to claim 1, wherein the first step for charging, the first step for discharging, the second step for charging and the second step for discharging are repeated with a repetition rate superior or equal to once per second.

3. The method according to claim 1, wherein a capacitance is defined for the capacitor, an inductance being defined for the coil, a resistance being defined for the series circuit, the capacitance, the inductance and the resistance being such that the following equation is verified:

$$\frac{L}{R} \geq \frac{C}{0.16}$$

wherein L is the inductance, R is the resistance and C is the capacitance.

4. The method according to claim 1, wherein the switch comprises two arms connected in parallel between the second extremity and the second electrode, each arm comprising a thyristor and a diode connected in series, the diode and thyristor of each arm being each inverted with respect to the diode and thyristor of the other arm.

5. The method according to claim 1, wherein each first and second step for discharging is immediately followed by a temporization step, the switch being in the first configuration and the second electrode being electrically disconnected from the electrical supply during the temporization step, the temporization step having a time duration superior or equal to 5 milliseconds.

6. The method according to claim 1, wherein each step for discharging comprises successively:

1. A first step for commuting the switch from the first configuration to a second configuration,
2. a step for discharging the second electrode through the coil, and
3. a second step for commuting the switch to the first configuration, a time period between the first step for commuting and the second step for commuting being comprised between 10 microseconds and 100 microseconds.

7. The method according to claim 1, wherein each first or second step for charging comprises steps for:

electrically connecting the second electrode to the electrical supply, estimating a value of the electrical charge of the second electrode, and disconnecting the second electrode from the electrical supply when the value of the electrical charge is equal to a predetermined value.

8. A computer program product comprising software instructions configured to implement a method according to claim 1 when the software instructions are executed by a processor.

9. An information-carrying medium onto which a computer program product according to claim 8 is memorized.

10. A device for generating a pulsed magnetic field comprising an electrical supply, a switch, a capacitor, a control module and a coil having a first extremity connected to an electrical ground and a second extremity, the capacitor comprising a first electrode connected to the electrical ground and a second electrode, the switch being able to commute between a first configuration wherein the second electrode and the second extremity are electrically insulated and at least one second configuration wherein the second electrode and the second extremity are electrically connected, the capacitor, the switch and the coil forming a series circuit when the switch is in the second configuration, the series circuit being underdamped, the electrical supply being able to commute being a third configuration wherein the electrical supply is able to charge the second electrode with an electrical charge having a first polarity and a fourth configuration wherein the electrical supply is able to charge the second electrode with an electrical charge having a second polarity different from the first polarity, the control module being able to command the electrical supply to commute between the third configuration and the fourth configuration, the control module (35) further being able to command the supply (20) to connect to or disconnect from the second electrode (45), the control module (35) being configured to implement the steps of a method according to claim 1.

* * * * *